US010234197B2

(12) United States Patent
Böhn

(10) Patent No.: US 10,234,197 B2
(45) Date of Patent: Mar. 19, 2019

(54) DRYER FOR A TEXTILE WEB, WITH IMPROVED HOT-AIR SUPPLY

(71) Applicant: TRUETZSCHLER GMBH & CO. KG, Moenchengladbach (DE)

(72) Inventor: Markus Böhn, Hainburg (DE)

(73) Assignee: TRUETZSCHLER GMBH & CO. KG, Moenchengladbach (DE)

( * ) Notice: Subject to any disclaimer, the term of this patent is extended or adjusted under 35 U.S.C. 154(b) by 0 days.

(21) Appl. No.: 15/602,025

(22) Filed: May 22, 2017

(65) Prior Publication Data

US 2017/0336142 A1 Nov. 23, 2017

(30) Foreign Application Priority Data

May 23, 2016 (DE) ..... 10 2016 109 413

(51) Int. Cl.

| | |
|---|---|
| ***F26B 11/04*** | (2006.01) |
| ***F26B 11/02*** | (2006.01) |
| *F26B 3/18* | (2006.01) |
| *F26B 11/08* | (2006.01) |
| *F26B 13/14* | (2006.01) |
| *F26B 13/16* | (2006.01) |

(52) U.S. Cl.

CPC ..... *F26B 11/0404* (2013.01); *F26B 11/028* (2013.01); *F26B 3/18* (2013.01); *F26B 11/08* (2013.01); *F26B 13/14* (2013.01); *F26B 13/16* (2013.01)

(58) Field of Classification Search

CPC ..... F26B 11/0404; F26B 11/028; F26B 3/18; F26B 11/08; F26B 13/14; F26B 13/16

USPC ..... 34/327

See application file for complete search history.

(56) References Cited

U.S. PATENT DOCUMENTS 2,225,166 A * 12/1940 Erby ..... D06C 3/00 34/114
2,429,338 A * 10/1947 Adams ..... D21F 5/02 34/115
3,783,526 A * 1/1974 Fleissner ..... D06B 19/0047 34/380
4,570,361 A * 2/1986 Fleissner ..... F26B 23/02 34/115

(Continued)

FOREIGN PATENT DOCUMENTS

DE 10 2012 109 878 B4 4/2015
DE 102016109413 A1 * 11/2017 ..... F26B 11/028

(Continued)

*Primary Examiner* — Stephen M Gravini
(74) *Attorney, Agent, or Firm* — FisherBroyles, LLP; Robert Kinberg

(57) ABSTRACT

A dryer for a textile web includes a drying chamber having at least one air-permeable drum arranged in the drying chamber to rotate, wherein the drum includes an end face constituting an axially arranged suction side, the textile web is wrapable at least partially around the drum and heated drying air is flowable through the textile web. A hot gas source provides heated gas. A ventilator forms a suction draft via the suction side of the drum with drying air from inside of the drum and drying air that recirculates back into the drying chamber. At least one hot gas feeding ring encloses the suction draft and is configured to permit the hot gas from the hot gas source to flow essentially completely into the suction draft.

12 Claims, 4 Drawing Sheets

(56) References Cited

U.S. PATENT DOCUMENTS

| | | | | | |
|---|---|---|---|---|---|
| 5,185,940 | A * | 2/1993 | Fleissner | F26B 13/16 34/114 |
| 5,901,462 | A * | 5/1999 | Rudd | F26B 13/14 34/122 |
| 6,151,797 | A * | 11/2000 | Fleissner | D06B 5/08 34/115 |
| 6,877,246 | B1 * | 4/2005 | Hada | D21F 5/182 34/119 |
| 7,926,147 | B2 * | 4/2011 | Saeger | D01G 15/40 19/217 |
| 8,997,371 | B2 * | 4/2015 | Bohn | F26B 13/16 162/359.1 |
| 9,696,088 | B2 * | 7/2017 | Bohn | F26B 13/16 |
| 2014/0215848 | A1 * | 8/2014 | Bohn | F26B 13/16 34/499 |
| 2014/0223765 | A1 * | 8/2014 | Bohn | F26B 13/16 34/477 |
| 2015/0267965 | A1 | 9/2015 | Boehn et al. | |
| 2017/0336142 | A1 * | 11/2017 | Bohn | F26B 11/028 |

FOREIGN PATENT DOCUMENTS

| | | | | |
|---|---|---|---|---|
| EP | 3249327 | A1 * | 11/2017 | F26B 11/028 |
| GB | 2398303 | A * | 8/2004 | A41H 43/0214 |
| WO | WO 2006106106 | A1 * | 10/2006 | B65G 47/5104 |

* cited by examiner

DRYER FOR A TEXTILE WEB, WITH IMPROVED HOT-AIR SUPPLY

CROSS-REFERENCE TO RELATED APPLICATION

Priority is claimed to German Application No. 10 2016 109 413.7, filed May 23, 2016, the disclosure of which is incorporated herein by reference in its entirety.

BACKGROUND OF THE INVENTION

The present invention relates to a dryer for a textile web, with a drying chamber in which at least one air-permeable drum is arranged to rotate, around which the textile web can partially wrap itself, wherein heated up drying air can flow through the textile web, and wherein a ventilator is provided for forming via a suction side that is located axially to the drum a suction draft with the drying air from the drum inside and the drying air being recirculated back into the drying chamber, and wherein heated gas can by supplied from a hot gas source to the recirculating drying air.

German patent document DE 10 2012 109 878 B4 discloses a dryer for a textile web, with a drying chamber in which a plurality of air-permeable drums are arranged rotating. A ventilator pulls via the suction side the moist drying air from the inside of the drum, wherein each drum is assigned a separate ventilator. The suction draft formed by the ventilator of the drying air moves through the ventilator and then into a heating and ventilation chamber. An intermediate chamber is positioned between an end face of the drum and the heating and ventilation chamber to form a closed space which, however, is connected to the suction draft. The moist drying air consequently flows from the inside of the drum into the intermediate chamber, and the ventilator then suctions in the drying air via its suction side and releases it into the heating and ventilation chamber. In the intermediate chamber, fresh air is supplied to the drying air and a portion of the moist drying air is discharged as exhaust air from the intermediate chamber.

Heating elements arranged in the heating and ventilation chamber serve to introduce the heat necessary for heating up the drying air. The heating elements are arranged in the heating and ventilation chamber in such a way that the stream of drying air flowing radially or tangentially out of the ventilator flows around them.

One disadvantage is that depending on the configuration and arrangement of the heating elements in the heating and ventilation chamber, some components of the drying air have differing temperatures when the drying air flows from the heating and ventilation chamber via an antechamber into the drying chamber. It is thus not totally ensured that following a flowing of air through the perforated cover, which separates the antechamber and the drying chamber, the temperature of the drying air is uniform over the complete width for admitting the textile web.

SUMMARY OF THE INVENTION

It is an object of the invention to improve a dryer for a textile web, with an improved hot-air supply. In particular, supplying the hot-air should be as efficient as possible, and the drying air for admitting to the textile web should have a uniform temperature, if possible, over the total width of the textile web.

The above and other objects are achieved by the invention, wherein according to one embodiment there is provided a dryer for a textile web, comprising: a drying chamber having at least one air-permeable drum arranged in the drying chamber to rotate, wherein the drum includes an end face constituting an axially arranged suction side, and the textile web is wrapable at least partially around the drum and heated drying air is flowable through the textile web; a hot gas source to produce heated gas; a ventilator to form a suction draft via the suction side of the drum with drying air from inside of the drum and drying air that recirculates back into the drying chamber, and at least one hot gas feeding ring enclosing the suction draft configured to permit the hot gas from the hot gas source to flow essentially completely into the suction draft.

The invention thus includes the technical teaching that at least one hot-gas supply ring is provided, which encloses the suction draft, and that the hot gas can flow via this ring essentially to the full extent into the induced draft.

The core idea behind the invention is a targeted feeding in of the hot gas ahead of the ventilator, so that a mixing occurs of the hot gas with the drying gas suctioned from the inside of the drum, wherein the mixing operation can be particularly effective owing to the fact that the mixture of drying air and hot gas flows through the ventilator. The drying air flows together with the hot gas through the ventilator, wherein the mixture is suctioned in axially and flows off radially or tangentially from the ventilator. The heated drying air flowing off can subsequently again enter the drying chamber, wherein the entrance into the drying chamber occurs at a uniform temperature, and the textile web is admitted over the complete width with drying air having a uniform temperature.

According to an embodiment, the hot-gas feeding ring is provided in at least one region of the circumference with a hot gas channel connection, preferably radially directed toward a ring center of the hot-gas feeding ring, by means of which the hot gas can be supplied to the hot-gas feeding ring. The hot gas travels from the hot gas channel connection via a hot-gas channel in the hot gas feeding ring and is distributes essentially completely over the circumference of the hot-gas feeding ring. Guide sheets, for example, can be provided for this within the hot-gas feeding ring. A geometric configuration of the hot-gas feeding ring can also be embodied such that the hot gas is distributed as uniform as possible over the circumference of the hot-gas feeding ring and thus also the circumference of the suction draft. The hot gas may thus be fed uniformly over the circumference into the suction draft, without especially hot or colder regions occurring in the mixture of drying air and hot gas.

According to another embodiment, the hot-gas feeding ring is configured such that an end face of the drum adjoins a first side of the hot-gas feeding ring. A suction intake of the ventilator may be thus be arranged at a second side of the hot-gas feeding ring and/or adjoins it. In other words, the hot-gas feeding ring may be located according between the end of the drum and the suction intake of the ventilator. The end face of the drum in that case can thus coincide with a separating wall between the drying chamber for accommodating the drum and, for example, a ventilation chamber which accommodates the ventilator. The hot-gas feeding ring can be attached to this separating wall. The separating wall contains a through opening, having the opening width, for example, of the drum inside, so that the inside of the drum essentially is open completely towards the ventilation chamber. The open end face of the drum may adjoin the inside opening of the hot-gas feeding ring so that no drying air from the drum inside can flow back into the drying chamber, without first flowing through the hot-gas feeding ring and finally the ventilator.

According to an embodiment, the hot gas source may include a gas blower burner with a combustion tube. The hot gas source in that case may be connected to a hot gas channel so that the flue gas of the gas blower burner flows completely into the hot gas channel and finally into the hot gas feeding ring. The flue gas finally flows via the hot gas feeding ring, into the drying air and heats up this air. The combustion tube of the gas blower burner here forms the connection to the hot gas channel. Embodying the hot gas source as a gas blower burner has the advantage that a flue gas extraction already takes place, which blows the hot flue gas via the hot gas channel into the hot gas feeding ring. In addition, on the inside of the hot gas-feeding ring a low pressure can be generated in the feeding ring through the suction draft flowing through it, so that additionally and as a result of this suction effect, the flue gas of the gas blower burner can be pulled via the combustion tube, the hot gas channel and the hot gas-feeding ring into the suction draft for the drying air.

According to another embodiment, a ventilation chamber is provided which adjoins the back of the drying chamber. The moist drying air flows from the inside of the drum via the opening through the hot-gas feeding ring and finally through the ventilator into the ventilation chamber. The combustion tube for the hot-gas source may be routed, at least in some sections through the ventilation chamber, so that the recirculating drying air may be additionally heated up by convection on the hot combustion tube.

A dryer for drying a textile web, for example following a washing operation or a needling operation by means of a water jet, generally is provided with more than one drum around which the textile web is guided. For example, a dryer may have two or possibly three drums, and the textile web is guided via an intake into the drying chamber and wraps itself around a first drum, for example around a first side by approximately 180°, wherein the textile web then wraps itself around a second drum on an opposite side, also by approximately 180°. A third and last drum may follow, for example, around which the textile web again wraps itself from the opposite side. Finally, the textile web leaves the drying chamber via an outlet. The intake and the outlet may be slot-shaped openings in the dryer chamber housing through which only small amounts of the drying air can escape or enter. Ventilators are assigned to each inside space of the individual drums, which are located in or in respectively separate ventilation chambers. As a result, a hot gas feeding ring is advantageously provided for the feeding of hot air into each of the suction drafts from the drum inside.

According to another embodiment, two the of hot gas-feeding rings may be supplied with hot gas, by connecting the two hot gas-feeding rings to a joint hot gas source. The combustion tube of the gas blower burner can be adjoined in this case by an angular housing, provided with a first connection output for connecting it to a first hot gas channel and a second output for connecting it to a second hot gas channel.

Alternative to a gas blower burner with a combustion tube that forms the hot gas source, external hot gas sources can also be provided. An additional advantage is thus achieved if, with reference to a drum, a first hot gas feeding ring is provided which is connected to a first hot gas source and if a second hot gas feeding ring is provided that is connected to a second hot gas source, wherein both hot gas feeding rings are arranged adjacent to each other and enclosing the suction draft. The second hot gas source in this case can be a peripheral heating source.

For an optimum feeding of the hot gas into the suction draft, the hot gas feeding ring may have a U-shaped box profile, wherein an exit opening is formed which points radially toward the inside. The hot gas feeding ring may have a channel connection with a large cross section and, with reference to the course of the suction draft, the axial cross-section height may be reduced along a center axis for the hot gas feeding ring, meaning in the direction of the exit opening to ensure an accelerated entrance of the hot air into the suction draft. Guide sheets inside the U-shaped box profile of the hot gas feeding ring can thus ensure the most uniform exit flow speed from the hot gas feeding ring into the suction draft for the feeding of the hot gas.

According to one variant of the dryer, an intermediate chamber can be formed between the drying chamber and the ventilation chamber, to which fresh air can be supplied and/or from which exhaust air can be released, wherein at least one hot gas feeding ring is arranged in the intermediate chamber. For example, a first hot gas feeding ring can be arranged in the intermediate chamber which is connected to a first hot gas source while an additional hot gas feeding ring is arranged in the ventilation chamber which is connected to an additional hot gas source.

BRIEF DESCRIPTION OF THE DRAWINGS

Further measures that improve the invention are explained in the following together with the description of a preferred embodiment and with the aid of the Figures, in which.

DETAILED DESCRIPTION OF THE INVENTION

Figure 1:
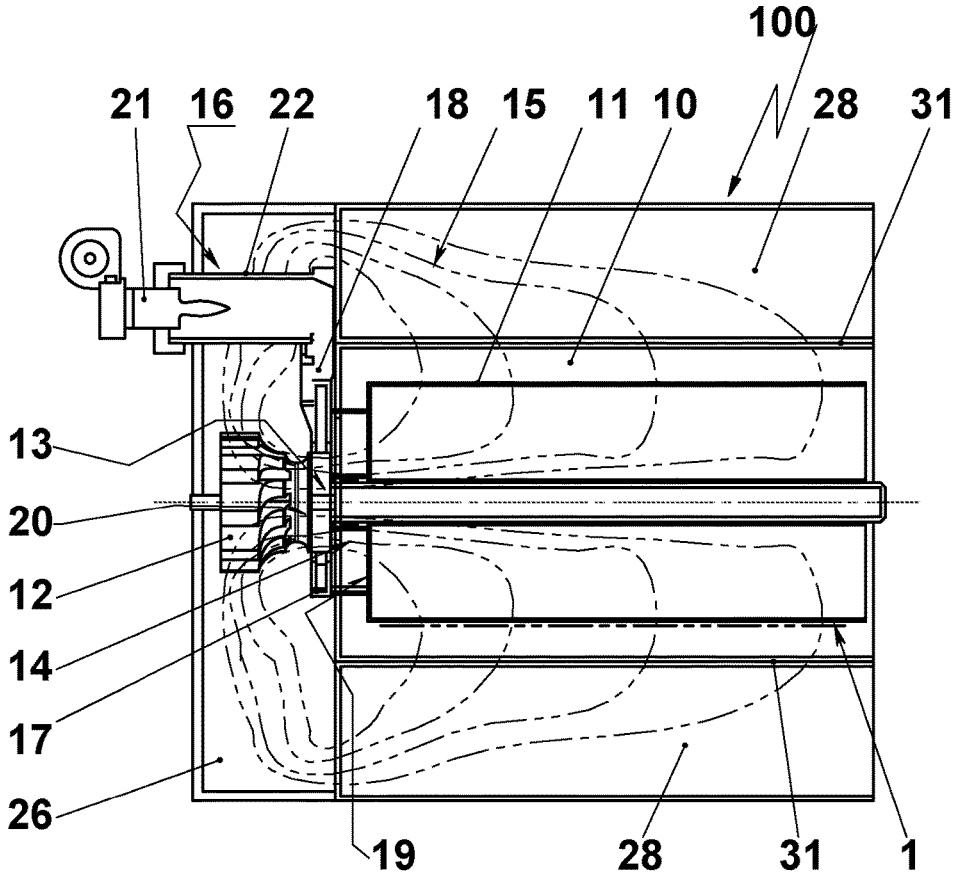
FIG. 1 is a cross-sectional view through a dryer, showing a drum and the arrangement of a hot gas feeding ring according to the invention.

The cross-sectional view in FIG. 1 shows a dryer 100 for a textile web 1 with a drying chamber 10 in which an air-permeable drum 11 is arranged to rotate and the textile web 1 is wrapped around the drum 11. Also provided is a ventilator 12 which can function to form via a suction side 13, embodied axial to the drum 11, a suction draft 14 of air coming from the drum 11 inside and to recirculate drying air 15 back into the drying chamber 10, and wherein heating gas can be supplied to the recirculating drying air 15 with the aid of a hot gas source 16. The drying air flows from a ventilation room 26, in which the ventilator 12 is position, initially into an antechamber 28. The antechamber 28 is separated from the dryer room 10 by a screening cover 31, wherein antechambers 28 with screening covers 31, which separate the antechambers 28 from the drying chamber 10, are embodied on the top as well as the bottom side of the drum 11. The screening covers 31 result in further uniformity in the heated drying air 15 which enters the antechambers 28 and flows evenly via the screening covers 31 into the drying chamber 10.

The invention provides a hot gas feeding ring 17 for feeding hot gas into the drying air 15, wherein this ring encloses the suction draft 14, so that the hot gas can essentially flow completely into the suction draft. In the process, the drying air 15 in the form of the suction draft 14 from the inside of the drum 11 mixes with the hot gas before reaching the ventilator 12. Owing to the turbulence in the ventilator 12, the moist drying air 15 from the drum 11 mixes homogeneously with the hot gas from the hot gas source 16. Finally, the well mixed drying air 15 can flow from the ventilation chamber 26 into the antechamber 28.

According to the embodiment shown, the hot gas source 16 is a gas blower burner 21 with adjoining combustion tube 22. The combustion tube 22 extends at least partially into the ventilation chamber 26, to allow convection heating of the drying air 15 on the outside of the combustion tube 22, thereby further heating up the drying air 15, as represented by the arrows extending in a radial direction from the combustion tube 22.

The arrangement of the drum 11 shows that the end face 19 essentially adjoins the hot gas feeding ring 17 and that the ventilator 12 is provided with a suction side 13 which is adjoined by the hot gas feeding ring 17 on the side opposite the end face 19 of the drum 11. The hot gas feeding ring 17 thus forms a transition from the end face side 19 of the drum 11 to the suction side 13 of the ventilator 12.

Figure 2:
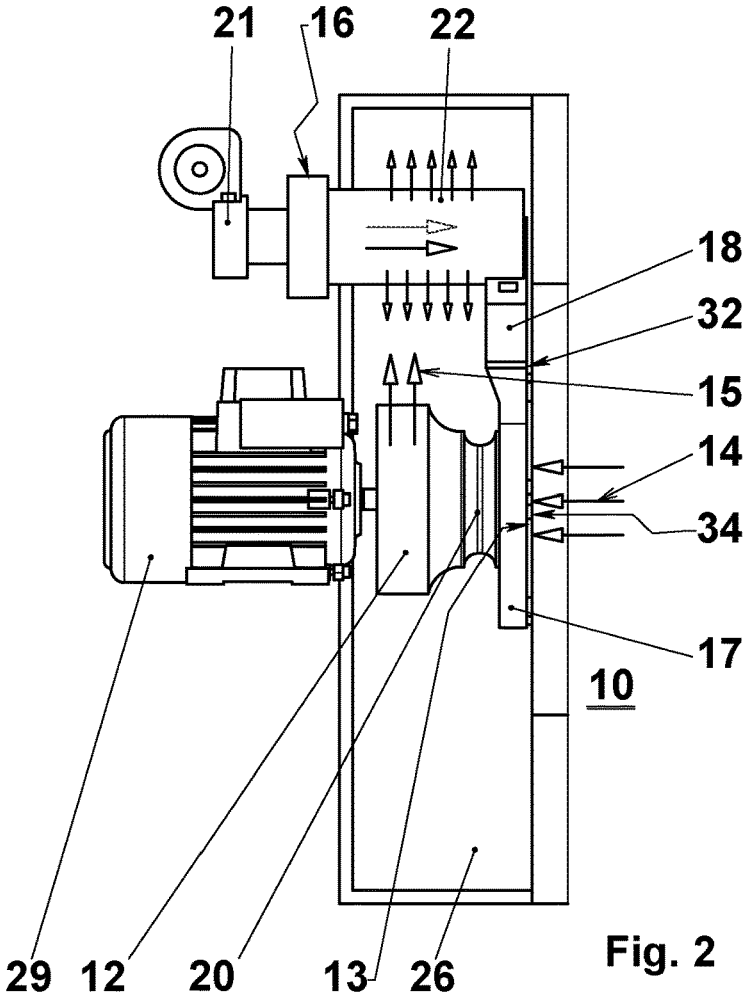
FIG. 2 is another view of the arrangement of the hot gas feeding ring.

FIG. 2 shows a detailed view of the ventilation chamber 26 which is arranged adjacent to the drying chamber 10, not shown in further detail herein. The suction draft 14, suctioned in via its suction intake 20 and through the hot gas feeding ring 17, is shown with a number of arrows. The suction draft 14 is drawn from the inside of a drum, wherein the non-depicted drum has a suction side 13 that adjoins a separating wall 32 which separates the drying chamber 10 from the ventilation chamber 26. To guide the suction draft 14 through, the separating wall 32 has an opening 34 which is made to coincide with the suction side 13 of the drum.

The drying air 15 leaves the ventilator 12 and flows into the ventilation chamber 26, wherein the drying air 15 is shown with an additional number of arrows. Hot gas is generated with the aid of the hot gas source 16, which comprises a gas blower burner 21 and a combustion tube 22. The hot gas is supplied via a hot gas channel 18 and the following hot gas feeding ring 17 to the suction draft 14. The hot gas mixes with the suction draft 14 and meanders through the ventilator 12. The temperature of the drying air 15 is thus higher than the temperature of the drying air in the suction draft 14. On the back of the ventilator 12, a motor 29 is shown which is located outside of the ventilation chamber 26, in the same way as the gas blower burner 21.

Figure 3:
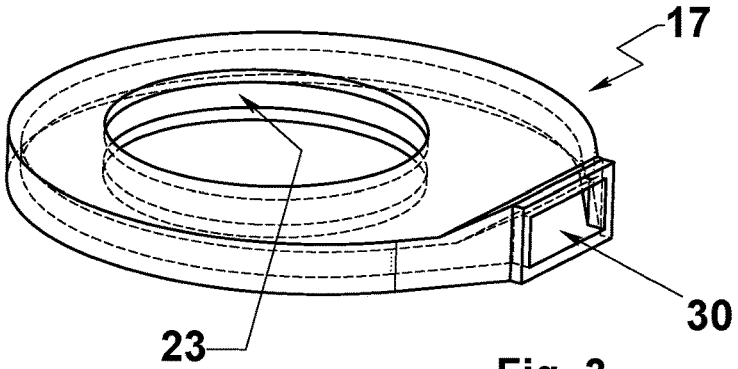
FIG. 3 is a perspective view of the hot gas feeding ring.

FIG. 3 shows a perspective view of a hot gas feeding ring 17 provided with a channel connection 30, wherein the channel connection 30 can be connected to the hot gas channel 18 (see FIG. 2). The hot gas feeding ring 17 has a U-shaped box profile which forms an outlet opening 23 in a radial direction toward the inside through which the hot gas can be fed into the suction draft 14.

Figure 4:
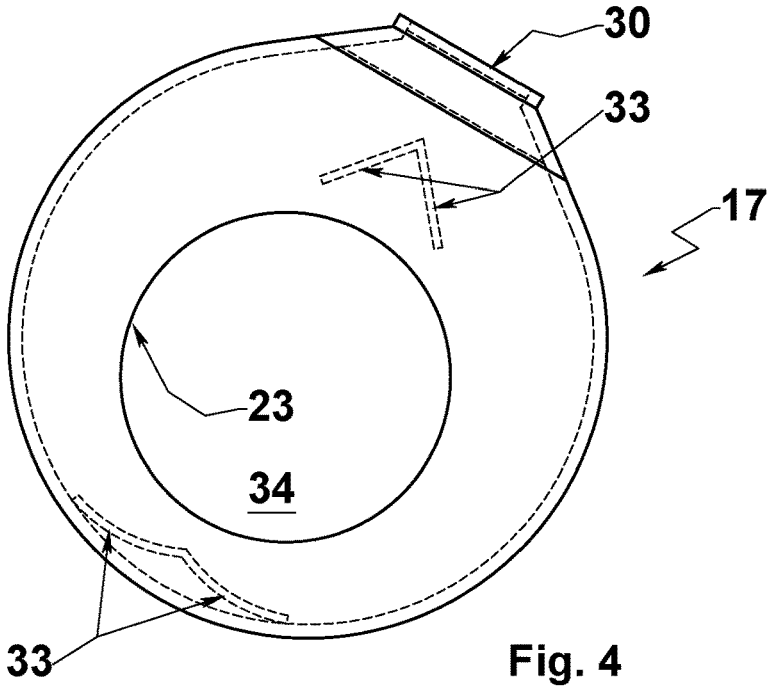
FIG. 4 is a view from the side of the hot gas feeding ring.

FIG. 4 shows a view from the side of the hot gas feeding ring 17. Also shown are guide sheets 33 which function to mostly even out the hot gas discharge over the circumference of the outlet opening 23.

The hot gas feeding ring 17 is furthermore designed such that the through opening 34 is formed off-center, with reference to the U-shaped box profile, so that the U-shaped box profile has a greater profile depth in the direction toward the channel connection 30 while the U-shaped box profile is tapered toward the point opposite the channel connection 30. Owing to the cross section becoming smaller, the flow of hot gas thus is evened out within the hot gas feeding ring 17, such that the hot gas essentially exits the outlet opening 23 uniformly distributed over the circumference.

Figure 5:
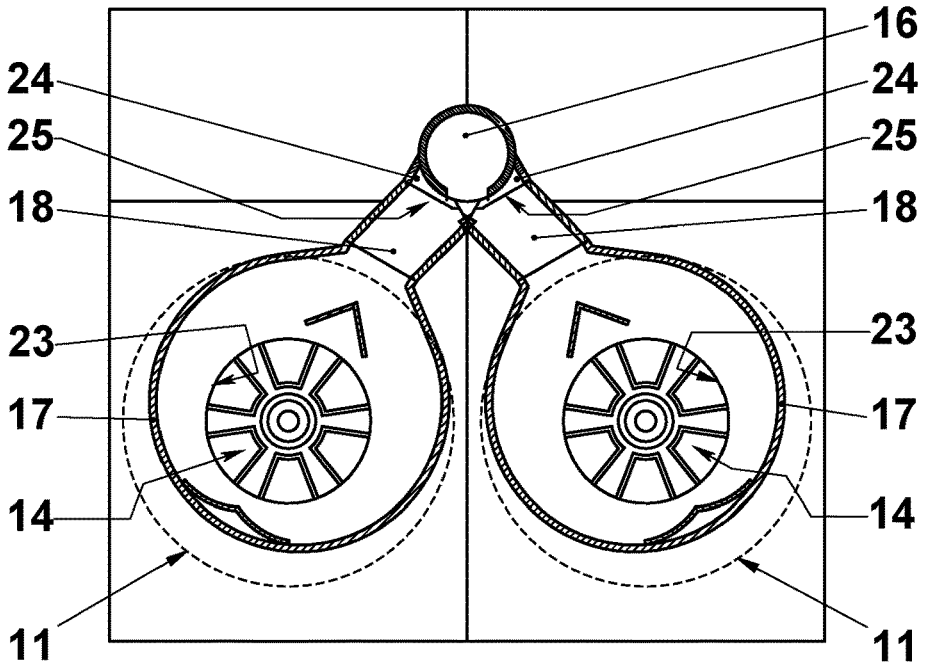
FIG. 5 is an arrangement of two hot gas feeding rings which are respectively assigned to a separate drum and are supplied with hot gas from a joint hot gas source.

FIG. 5 shows another exemplary embodiment of an arrangement of two hot gas feeding rings 17, respectively arranged upstream of a respective drum 11, wherein the hot gas feeding rings 17 are supplied via a joint hot gas source 16. An angular housing 24, which is provided with separate connecting outlets 25 for connecting hot gas channels 18, functions to divide the hot gas coming from the hot gas source 16. As a result, respectively one hot gas channel 18 connects the hot gas feeding rings 17 with the hot gas source 16. The hot gas channels 18 consequently are arranged at an angle to each other, wherein the hot gas source 16 between the two hot gas feeding rings 17 is arranged off-center. If hot gas is supplied via the hot gas source 16 and the hot gas channels 18 extend to the hot gas feeding rings 17, the hot gas can flow as previously described via the respective exit openings 23 of the hot gas feeding rings 17 into the suction draft 14 on the respective sides of the drums 11.

Figure 6:
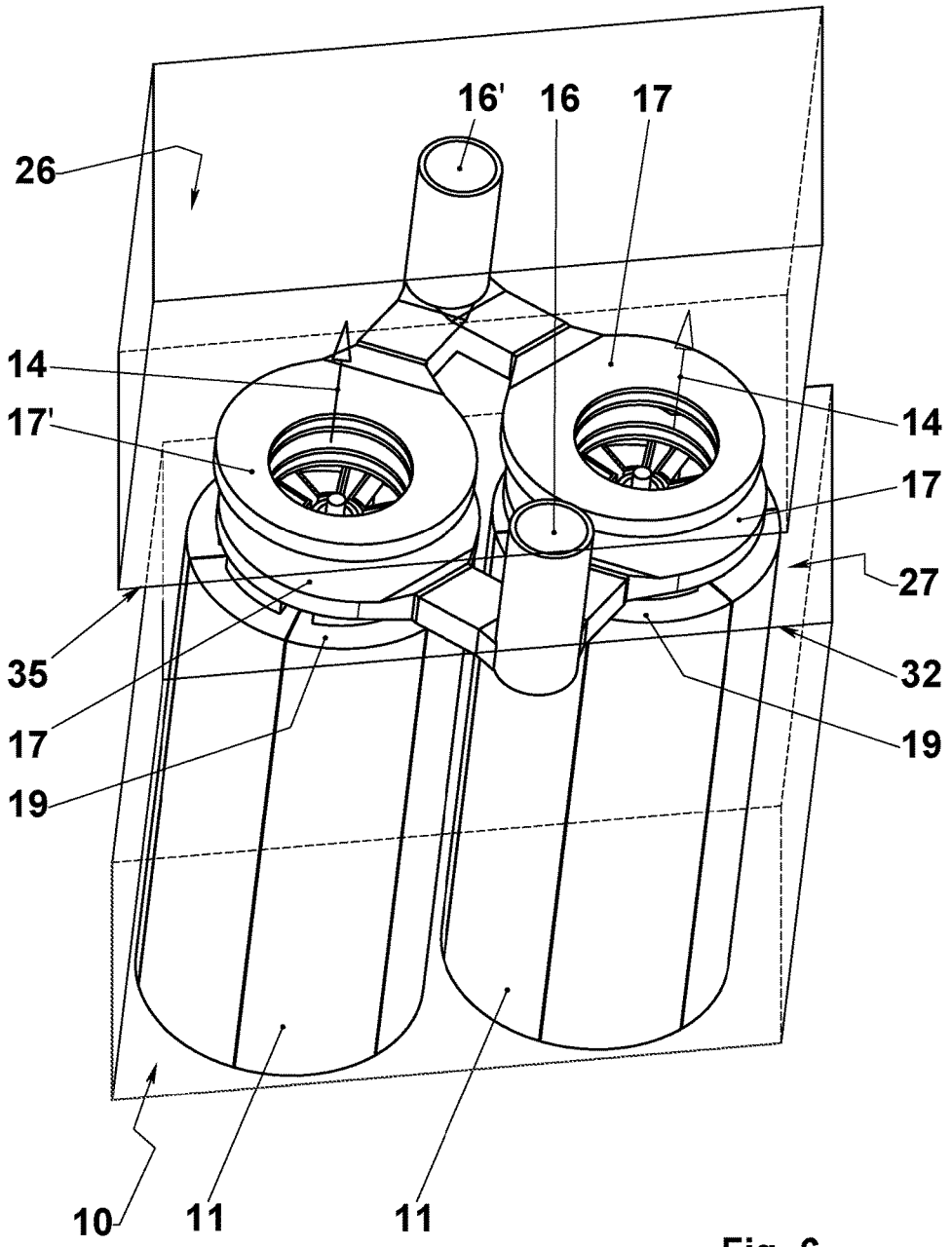
FIG. 6 is a perspective view of two drums with respectively two hot gas feeding rings positioned in front of the drum end faces, wherein respectively two hot gas feeding rings of adjacent drums are supplied with hot gas from a joint hot gas source.

FIG. 6 shows a perspective view of two drums 11 inside a drying chamber 10, not shown further herein. The exemplary embodiment shows an intermediate chamber 27, wherein this intermediate chamber 27 is separated from the drying chamber 10 by the separating wall 32. Located in front of the intermediate chamber 27 is the ventilation chamber 26 which is separated via a different separating wall 35 from the intermediate chamber 27.

A first pair of hot gas feeding rings 17 is connected to a first hot gas source 16, and a second pair of hot gas feeding rings 17' is connected to a second hot gas source 16'. The pairs of hot gas feeding rings 17 and 17' are arranged such that a hot gas feeding ring from the first pair 17 is located in front of an end face 19 of the drum 11 and, adjacent thereto, a further hot gas feeding ring of the second pair 17' is arranged in an adjacent arrangement.

For this, the first hot gas source 16 can be a gas blower burner with a combustion tube and the second hot gas source 16' can be an external heat source, for example a peripherally arranged cogeneration plant. The two hot gas sources 16 and 16' are thus provided via respective hot gas feeding rings 17 and 17' for each suction draft which is generated via the end faces 19 from the drums 11.

The embodiment of the invention is not restricted to the above-mentioned, preferred embodiment. Rather, a number of variants are conceivable which use the solution shown, even with basically very differently designed embodiments.

It will be understood that the above description of the present invention is susceptible to various modifications, changes and adaptations, and that the same are intended to be comprehended within the meaning and range of equivalents of the appended claims.

What is claimed is:

1. A dryer for a textile web, comprising:

a drying chamber having at least one air-permeable drum arranged in the drying chamber to rotate, wherein the drum includes an end face constituting an axially arranged suction side, the textile web is wrapable at least partially around the drum and heated drying air is flowable through the textile web;

a hot gas source to produce heated gas;

a ventilator to form a suction draft via the suction side of the drum with drying air from inside of the drum and drying air that recirculates back into the drying chamber, and at least one hot gas feeding ring enclosing the suction draft configured to permit the heated gas from the hot gas source to flow essentially completely into the suction draft.

2. The dryer according to claim 1, wherein the hot gas feeding ring has a circumference and includes in at least one region of the circumference a heating channel that is tapered toward a ring center of the hot gas feeding ring via which the heated gas is conducted in the hot gas feeding ring.

3. The dryer according to claim 1, wherein the hot gas feeding ring includes a first side that adjoins the end face of the drum and a second side, and further including a ventilator arranged on the second side of the hot gas feeding ring.

4. The dryer according to claim 1, wherein the hot gas source comprises a gas blower burner and a combustion tube coupled to the gas blower burner.

5. The dryer according to claim 4, further including a ventilation chamber in which the ventilator is arranged, wherein the combustion tube extends at least in some sections through the ventilation chamber to allow convection heating of the drying air on an outside of the combustion tube.

6. The dryer according to claim 1, wherein the at least one air permeable drum comprises two air permeable drums, the hot gas source comprises a first hot source and a second hot gas source, and the at least one hot gas feeding ring comprises a first hot gas feeding ring connected to the first hot gas source and a second hot gas feeding ring connected to the second hot gas source, wherein both hot gas feeding rings are arranged adjacent to each other to enclose the suction draft of a respective one of the drums.

7. The dryer according to claim 6, wherein the second hot gas source comprises a peripheral heating source.

8. The dryer according to claim 6, wherein the hot gas feeding rings each have a circular U-shaped box profile and one exit opening arranged to point radially toward an inside of the hot gas feeding ring.

9. The dryer according to claim 1, wherein the dryer incudes a plurality of drums and the at least one hot gas feeding ring includes at least one hot gas feeding ring associated with each of the drums.

10. The dryer according to claim 9, wherein the hot gas source constitutes a joint hot gas source and the at least one hot gas feeding ring comprise first and second hot gas feeding rings connected to the joint hot gas source.

11. The dryer according to claim 10, wherein the hot gas source comprises a combustion burner adjoined by a housing comprising a first connection outlet to attach a first hot gas channel and a second connection outlet spaced from the first connection outlet to attach a second hot gas channel that extends from the housing at an angle with respect to the first hot gas channel.

12. The dryer according to claim 5, further including an intermediate chamber between the drying chamber and the ventilation chamber, wherein the intermediate chamber includes at least one of an inlet to receive a stream of fresh air and an outlet from which exhaust air can be released, and wherein the at least one hot gas feeding ring is arranged in the intermediate chamber.

* * * * *